US005860256A

United States Patent [19]

Humber

[11] Patent Number: 5,860,256

[45] Date of Patent: Jan. 19, 1999

[54] TWO-PIECE ROOF VENT FLASHING AND METHOD FOR MAKING SAME

[75] Inventor: Jeffrey A. Humber, Memphis, Tenn.

[73] Assignee: IPS Corporation, Gardenia, Calif.

[21] Appl. No.: 353,190

[22] Filed: Dec. 9, 1994

[51] Int. Cl.[6] ..... E04D 13/14; E04D 1/36

[52] U.S. Cl. ..... 52/219; 52/58; 52/218; 285/42

[58] Field of Search ..... 52/219, 218, 199, 52/198, 60, 58; 285/42

[56] References Cited

U.S. PATENT DOCUMENTS

| | | | |
|---|---|---|---|
| 4,010,578 | 3/1977 | Logsdon | 52/199 X |
| 4,160,347 | 7/1979 | Logsdon . | |
| 4,264,058 | 4/1981 | Logsdon . | |
| 4,280,305 | 7/1981 | Logsdon | 52/199 X |
| 4,526,407 | 7/1985 | Kifer . | |
| 4,864,782 | 9/1989 | Hasty . | |
| 5,036,636 | 8/1991 | Hasty | 52/219 X |
| 5,237,789 | 8/1993 | Thater | 52/219 |
| 5,328,212 | 7/1994 | Kosik, Jr. et al. | 285/42 |
| 5,347,776 | 9/1994 | Skoff | 52/219 |

FOREIGN PATENT DOCUMENTS 1310003 1/1971 United Kingdom .

OTHER PUBLICATIONS

Never–Leak device (as described in Info. Disclosure Statement attached hereto).

*Primary Examiner*—Robert Canfield
*Attorney, Agent, or Firm*—Joseph A. Yanny

[57] ABSTRACT

An improved two-piece roof flashing comprises a thermoplastic hard base and an elastomeric rain collar. The hard base comprises a planar base plate with a central dome-like portion, with the dome-like portion having a central opening with a solid flange inwardly disposed and encircling the opening. The rain collar has a central opening sized to accommodate an upstanding roof pipe. The rain collar is molded directly onto the solid flange of the hard base, with the resulting seam between the rain collar and hard base being strong and weathertight. When the collar is molded onto the flange of the base element, the materials of the collar and flange fuse together along the seam between the collar and base element. Additionally, with the collar directly molded to the flange, the design of the flange creates a lengthy path that water must traverse in order to penetrate the roof flashing.

22 Claims, 3 Drawing Sheets

TWO-PIECE ROOF VENT FLASHING AND METHOD FOR MAKING SAME

BACKGROUND OF THE INVENTION

1. Field of the Invention

The invention relates to an improved flashing for roof-top vent pipes, comprising a thermoplastic hard base and an elastomeric rain collar. More specifically, the invention relates to an improved manner of connecting the hard base and rain collar together to form the completed flashing.

2. Brief Description of the Prior Art

Two-piece roof vent flashings are known. For example, British Patent 1,310,003 to BAMBROUGH shows a two-piece roof vent flashing, comprising an aluminum base element with a neoprene collar. The BAMBROUGH collar is connected to the aluminum base either through various mechanical connections, adhesives, or frictional attachments, depending on the particular embodiment. LOGSDON '347 (U.S. Pat. No. 4,160,347) describes a two-piece roof vent flashing comprising a base housing with a sealing collar. The sealing collar is mated with the base housing, and is mechanically held in position by a series of holding flanges on the interior wall of the base housing. LOGSDON '058 (U.S. Pat. No. 4,264,058) shows a two-piece roof flashing structure comprising a hard base and an elastomeric sealing collar. The sealing collar is molded directly onto annular supports, with a series of holes positioned in the inner annular support. During the molding process, material from the collar passes into holes in the inner annular support, thus creating a positive mechanical lock between the collar and base.

KIFER (U.S. Pat. No. 4,526,407) discloses an elastomeric sealing collar connected to a thermoplastic hard base. In KIFER, the sealing collar is molded to a flange on the hard base. The flange has a series of holes therethrough, so that a series of positive mechanical closed-loops are created between the hard base and sealing collar when the sealing collar is molded. HASTY (U.S. Pat. No. 4,864,782) discloses a thermoplastic hard base and an elastomeric sealing collar molded directly to a thermoplastic hard base. In HASTY, the flange has several holes therethrough, allowing the elastomeric material of the collar to pass through the holes during the collar's molding process. Thus, a series of positive mechanical connections are created between the hard base and sealing collar.

Prior art roof flashings involving thermoplastic to thermoplastic construction have relied on positive mechanical connections to maintain the two-part flashings together. One method in the prior art for creating a positive mechanical connection involves creating a flange on the base element, but with the flange having several holes of substantial size, as in HASTY and KIFER. These holes allow the elastomeric material of the collar to pass through the flange during the collar's molding process, thus creating a series of positive mechanical connections between the collar and the base element.

Several problems are created by the presence of holes in the flange. First, the holes necessarily compromise the structural integrity of the flange, increasing the likelihood of structural failure. The holes decrease the minimum path that water must follow to penetrate the flashing along the seam between the collar and the base element. Additionally, the perforated flanges increase the wastage resulting from molding the base element and from molding the collar onto the base element.

Solid flanges have been known in the art. For example, a roof flashing manufactured by the Never-Leak Company of Memphis, Tenn., has a solid flange. However, that flange is conical and relatively small in width.

Previous solid flange designs have been prone to failure of the seam between the flange and the collar, allowing water to penetrate. To compensate for anticipated seam failures, previous solid flanges have been generally conical in shape, with the conical flange sloping outwardly away from the center opening of the base element. Thus, water is diverted away from the center opening.

BRIEF SUMMARY OF THE INVENTION

The invention is an improved roof flashing for establishing a weather-proof seal with an upstanding pipe passing through an opening in a roof. The roof flashing comprises a base element and a collar, with the collar fitting tightly around the upstanding pipe to prevent water from passing through the roof flashing. The base element is integrally formed of thermoplastic and comprises a substantially planar base plate and an upstanding central dome-like portion with a central opening therein. The dome-like portion has a solid flange inwardly disposed and surrounding the central opening. The collar is integrally formed of elastomeric material and comprises a truncated, generally conical central portion and an outer, generally radially outwardly extending annular connecting portion. The central, conical portion of the collar has a hole sized to accommodate the upstanding roof pipe, such that the collar tightly fits around the upstanding pipe and prevents water from passing between the collar and pipe. The outer portion of the collar is molded directly to the solid flange portion of the base element, creating a strong, weathertight connection between the base element and collar.

The solid flange design adds greater strength and increased water-resistance to the roof flashing. When the collar is molded to the base element, the materials of the collar and base element are fused together along the seam between the collar and base element. This fusion between the two materials produces a strong, weathertight seal between the collar and base element. However, should the seam between the collar and base element be compromised such that water can pass along the seam, the solid flange creates a lengthy path the water must traverse before penetrating to the inside of the flashing.

In another embodiment, the solid flange includes raised ridges and/or recessed grooves. These ridges and grooves add additional surface area to the flange, thus increasing the area of fusion between the collar and base element and thereby strengthening the seam. Additionally, the ridges and grooves create additional obstacles to water penetration along the seam.

The above and other objects and advantages of the present invention will become more apparent when read in conjunction with the following description of a preferred embodiment of the invention.

DETAILED DESCRIPTION OF THE PREFERRED EMBODIMENT

Figure 1:
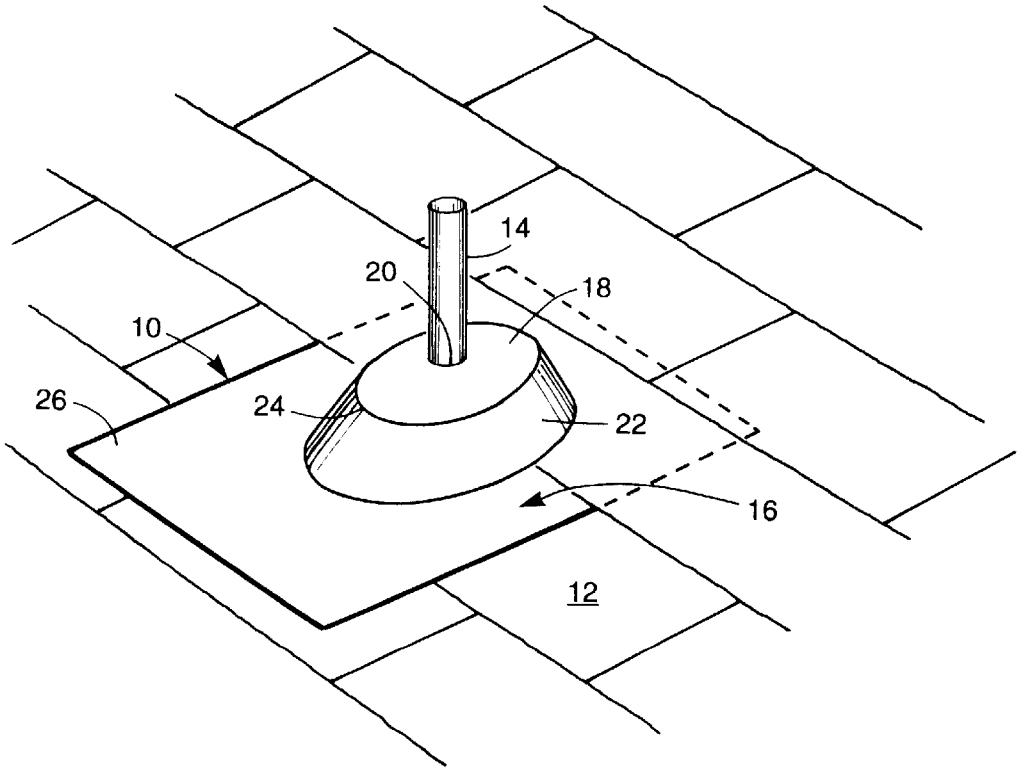
FIG. 1 is a perspective view of a roof flashing according to one embodiment of the invention, showing the flashing in a typical roof installation.

FIG. 1 shows in perspective view a roof flashing 10 according to the invention in a typical roof-top installation. The roof flashing 10 provides a weathertight seal, preventing water from seeping through the roof 12 where the vent pipe 14 penetrates the roof. The assembly is not, of course, limited to use with vent pipes. It may be used with almost any pipe or other object passing through a roof, as well as in other weather-sealing applications.

The roof flashing 10 comprises a base element 16 and a sealing collar 18. As shown in the figure, the vent pipe 14 passes through a pipe opening 20 in the sealing collar 18. The sealing collar 18 preferably fits tightly about the vent pipe 14, creating a weatherproof seal about the pipe. The collar 18 is itself secured to a dome-like member 22 of base element 16, with the seam 24 between the sealing collar 18 and the base element 16 being weatherproof.

The roof flashing 10 is secured to the roof via a generally planar base plate 26 which comprises part of the base element 16. The planar shape of the base plate member 26 conforms to the planar surface of most roofs, allowing the assembly to lie flatly against a generally planar roof. For installations involving roofs (or other intended surfaces) which have non-planar surface, the base member 26 may be manufactured with a shape that will conform to the roof's surface.

In a pitched-roof assembly as in FIG. 1, the sealing collar is positioned at an angle to the planar base member 26.

Figure 2:
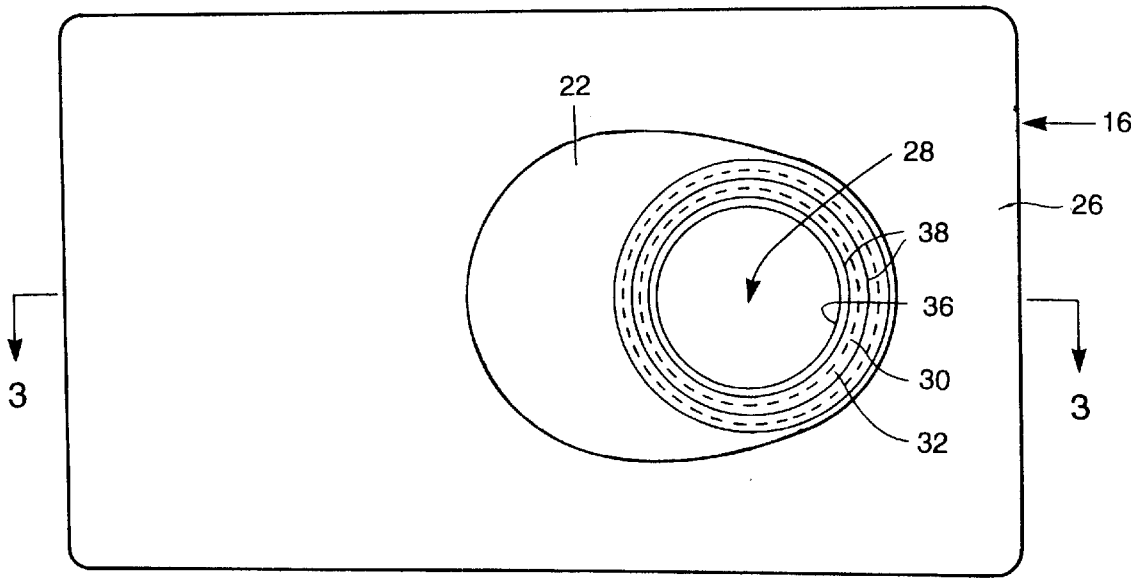
FIG. 2 is a top plan view of a base element according to one embodiment of the invention.

FIG. 2 shows in top plan view a hard base element 16 according to one embodiment of the invention. The base element 16 comprises a generally planar base member 26 and a dome-like member 22 having a central opening 28. A ring mount flange 30 surrounds the central opening 28 in the dome-like member 22. The flange has an upper 32, lower 34, and inner 36 surface. The flange 30 is of a solid construction, with no holes passing through from top to bottom.

In the embodiment shown, the flange 30 has two ridges 38 about its circumference on its upper surface 32. Although the ridges 38 are shown in this example as being continuous, in other embodiments the ridges may each be comprised of one or more segments about the circumference of the flange 30. Two ridges are shown in the embodiment of FIG. 2, but any number of ridges may be used. In lieu of or in addition to the ridges, the flange 30 may have one or more grooves 44 on its upper and/or lower surfaces. Such grooves 44, which are discussed further below with respect to FIG. 5, do not pass through the flange 30.

The base element 16 is preferably formed of a thermoplastic during an injection molding process. However, other materials and molding processes may also be used.

Figure 3:
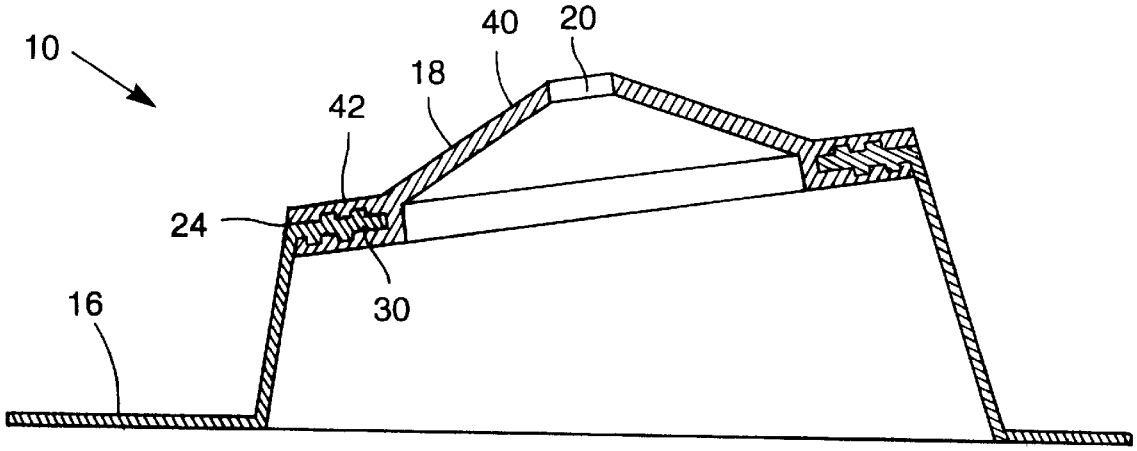
FIG. 3 is a vertically cross-sectional view along the longitudal axis of a roof flashing according to the invention.

FIG. 3 is a vertical section elevation view along the longitudinal axis of an assembled roof flashing 10 according to a preferred embodiment. The roof flashing 10 comprises the base element 16 from FIG. 2, but with the addition of an elastomeric sealing collar 18. The elastomeric collar 18 includes a generally circular pipe opening 20 through which a roof pipe can pass, with the collar 18 fitting tightly around the roof pipe to prevent the passage of water. The collar 18 further comprises a central portion 40 and an outer, generally radially outwardly extending annular connecting portion 42.

It should be noted that the collar 18 may be made with a variety of upper surface shapes and contours, including a substantially flat upper surface. However, for most installations, it is preferable that the collar's central portion 40 be somewhat conical. Such a conical shape helps to divert precipitation away from the collar's pipe opening 20.

During manufacture of the assembly, the base element 16 is molded in a first molding operation. Then, during a second molding step, the elastomeric collar 18 is molded directly onto the base element 16. During the second molding step, the materials of the collar 18 and the flange 30 are partially fused together along the common seam 24.

The material of the collar 18 may be different than the material of the base element 16. Increased strength of the common seam 24 can be achieved if, during the step of molding the collar to the flange, the material forming the collar is at a temperature approaching the melting point of the flange material. This encourages the materials of the flange and collar to fuse together, increasing the strength of the seam 24 between collar and base element.

As an example, in one embodiment the base element is formed of hard polypropylene, while the collar is formed of flexible polypropylene. When the flexible polypropylene of the collar is injected molded onto the base element, the hard polypropylene and flexible polypropylene fuse together along the common seam.

The annular connecting portion of the collar is molded directly to the flange 30. There is no positive mechanical connection between the collar 18 and the flange 30—instead, the connection between collar 18 and flange 30 is maintained by the bond created between the flange material and the collar material when the collar 18 is molded onto the flange 30.

Figure 4:
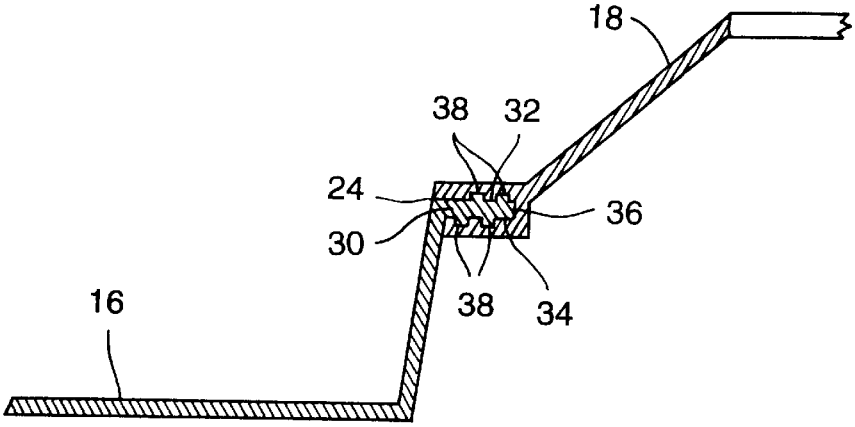
FIG. 4 is a fragmentary cross-sectional view of a portion of the roof flashing of FIG. 3.
Figure 5:
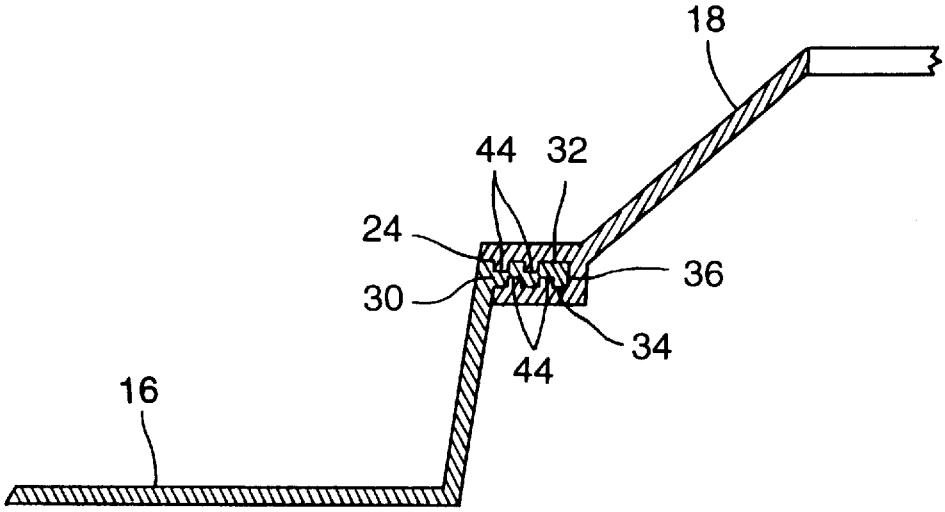
FIG. 5 is a fragmentary cross-sectional view of a portion of a further embodiment of the invention.

FIGS. 4 and 5 shows flange designs having substantial irregularities on their upper and/or lower surfaces. In the embodiments of FIGS. 4 and 5, the substantial irregularities are ridges 38 and grooves 44, respectively. These substantial irregularities serve to increase the effective bonding area between the collar 18 and flange 30. Additionally, the substantial irregularities complicate and increase the width of the seam 24 between the collar and flange. A wider, more complicated seam is less easily breached by water.

FIG. 4 is a fragmentary cross-sectional view of the area immediate the flange 30 according to one embodiment of the invention. The embodiment shown comprises a flange 30 with two ridges 38 on its upper surface 32 and two ridges 38 on its lower surface 34. The ridges of opposite surfaces are shown offset with respect to one another, although the spacing of the ridges may vary as a matter of design. Additionally, any number of ridges may be used.

The cross-sectional shape of the ridges 38 is a matter of design choice. The ridges 38 depicted in FIG. 4 have generally rectangular cross-sections, which are relatively easy to mold.

In the embodiment shown, the collar 18 is molded across the upper 32, inner 36, and lower 34 surfaces of the flange 30. This maximizes the bonding area between the collar 18 and flange 30, as well as increasing the effective width of the seam 24. In a typical base element made in accordance with the invention, the flange 30 may be on the order of ¼ to ½ inches or more in axial width. Since water would have to pass completely over the upper 32, inner 36, and lower 34 surfaces to penetrate the assembly, the distance involved to penetrate the seam, i.e., the minimum seam passage distance, would be on the order of ½ to 1 inches or more. Thus, in order for water to penetrate the seam, the seam would have to fail across its entire effective width (which is equivalent to the minimum seam passage distance), and then water would have to travel the minimum seam passage distance.

FIG. 5 shows in fragmentary cross-section another embodiment of the invention, where the flange 30 has, instead of ridges, a series of grooves 44 on its upper 32 and lower 34 surfaces. These grooves 44 serve substantially the same function as the ridges, including increasing the collar-to-flange bonding area and increasing the minimum seam passage distance along the seam 24 between the collar 18 and flange 30.

As shown in FIG. 5, the grooves 44 do not penetrate through the flange 30. As such, the flange 30 remains a solid structure, without perforations passing therethrough.

While the embodiment of FIG. 5 includes a series of two grooves 44 on both the upper 32 and lower 34 surfaces of the flange 30, the number of grooves on the upper 32 and lower 34 surfaces of different embodiments can vary from zero upwards. Additionally, the grooves may be combined with ridges, either on opposite or the same sides of the flange 30.

As with the ridges, the cross-sectional shape of the grooves 44 is a matter of design choice. Roughly rectangular cross-sections are depicted, which are relatively easy to mold. In preferred embodiments, the top opening of the groove is at least as wide as the widest inner width of the groove. This allows the base member to be easily constructed with known molding processes.

Figure 6:
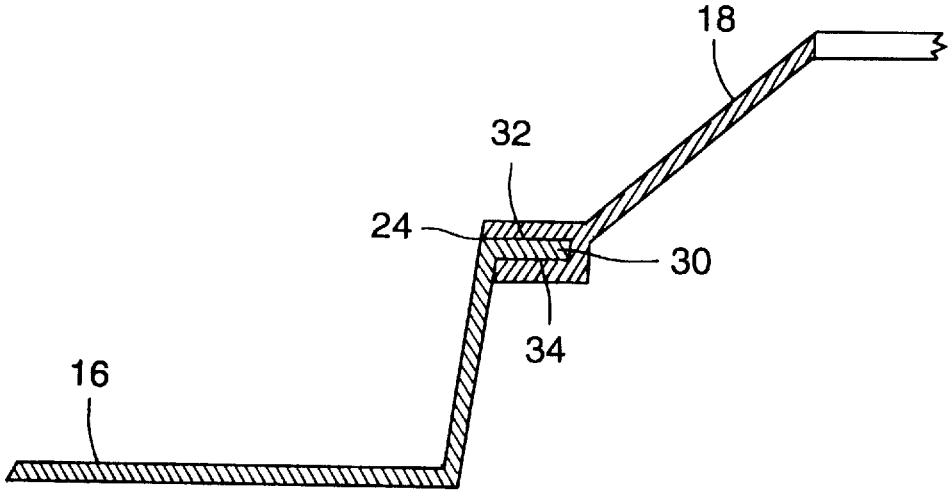
FIG. 6 is a fragmentary cross-sectional view of a portion of a further embodiment of the invention.

FIG. 6 shows in fragmentary cross-section still another embodiment of the invention, where the flange 30 has upper 32 and lower 34 surfaces which are substantially flat. A flat-surface flange simplifies the construction and operation of the molding apparatus. The flange has a planar (i.e., non-conical) shape. Although the resulting attachment seam 24 between the collar 18 and flange 30 defines a relatively smooth, unobstructed path, the bonding that occurs between the flange 30 and collar 18 in the collar's molding process makes the seam 24 weathertight and mechanically strong. Additionally, even if the seam 24 were somehow compromised so that water could pass therethrough, the distance which water must travel to penetrate the seam 24 is still relatively long.

Flat flange surfaces may be combined with ridged and/or grooved surfaces. For example, a flange may have a flat upper surface 32 and a ridged lower surface 34.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. A roof flashing for establishing a weather-proof seal with an upstanding pipe passing through an opening in a roof, said roof flashing comprising:

a base element, with said base element integrally formed of thermoplastic and comprising a base plate and an upstanding central dome portion with a central opening therein, said domed portion having a solid planar flange inwardly disposed and surrounding said central opening, with said solid planar flange having an upper, lower, and inner surface, and a sealing collar, said sealing collar being integrally formed of elastomeric material and comprising a central portion, said central portion having a generally circular opening therethrough, and an outer, generally radially outwardly extending annular connecting portion molded directly to the solid planar flange portion of said base member, thereby creating a connection between the sealing collar and the solid planar flange.

2. The roof flashing of claim 1, wherein the connection between the sealing collar and the solid planar flange defines a minimum seam passage distance of at least 1 inch.

3. The roof flashing of claim 1, wherein the solid flange has one or more integrally formed ridges on its upper surface.

4. The roof flashing of claim 1, wherein the solid flange has one or more integrally formed ridges on its lower surface.

5. The roof flashing of claim 3, wherein the solid flange has one or more integrally formed ridges on its lower surface.

6. The roof flashing of claim 5, wherein the ridges on the upper surface are alternately radially offset with respect to the ridges on the lower surface.

7. The roof flashing of claim 6, wherein the solid flange has at least two integrally formed ridges on each of its upper and lower surfaces, and said ridges are each continuous circumferentially about the circumference of the flange, whereby the ridges on a particular surface define a channel between each other.

8. The roof flashing of claim 3, wherein at least one of said ridges forms a continuous ridge circumferentially about the flange.

9. The roof flashing of claim 1, wherein the solid flange has one or more grooves in its upper surface.

10. The roof flashing of claim 1, wherein the solid flange has one or more grooves in its lower surface.

11. The roof flashing of claim 10, wherein the solid flange has one or more grooves in its upper surface.

12. A roof flashing for establishing a weather-proof seal with an upstanding pipe passing through an opening in a roof, said roof flashing comprising:

a base element, with said base element integrally formed of thermoplastic and comprising a base plate and an upstanding central dome portion with a central opening therein, said domed portion having a solid flange inwardly disposed and surrounding said central opening, with said flange having an upper, lower, and inner surface, and a sealing collar, said sealing collar being integrally formed of elastomeric material and comprising a central portion, said central portion having a generally circular opening therethrough, and an outer, generally radially outwardly extending annular connecting portion molded directly to the solid flange portion of said base member, thereby creating a connection between the sealing collar and the flange, wherein the connection between the sealing collar and the flange defines a minimum seam passage distance of at least 1 inch.

13. The roof flashing of claim 12, wherein the flange is planar.

14. A roof flashing for establishing a weather-proof seal with an upstanding pipe passing through an opening in a roof, said roof flashing comprising:

a base element, with said base element integrally formed of thermoplastic and comprising a base plate and an upstanding central dome portion with a central opening therein, said domed portion having a solid flange inwardly disposed and surrounding said central opening, with said solid flange having an upper and lower surface, said solid flange having a substantial irregularity on at least one of the flange surfaces, a sealing collar, said sealing collar being integrally formed of elastomeric material and comprising a central portion, said central portion having a generally circular opening therethrough, and an outer, generally radially outwardly extending annular connecting portion molded directly to the solid flange portion of said base member, thereby creating a connection between the sealing collar and the solid flange.

15. The roof flashing of claim 14, wherein the connection between the sealing collar and the solid flange defines a minimum seam passage distance of at least 1 inch.

16. The roof flashing of claim 14, wherein the connection between the sealing collar and the solid flange defines a minimum seam passage distance of at least 1 and ½ inches.

17. The roof flashing of claim 14, wherein the substantial irregularity comprises a ridge passing circumferentially about the flange.

18. The roof flashing of claim 17, wherein the solid flange has at least one ridge on both the lower and the upper surface of the flange.

19. The roof flashing of claim 18, wherein the solid flange has two ridges on its upper surface and two ridges on its lower surface.

20. The roof flashing of claim 14, wherein the substantial irregularity comprises a groove passing circumferentially about the flange.

21. The roof flashing of claim 20, wherein the solid flange has at least one groove on each of the lower and the upper surface of the flange.

22. The roof flashing of claim 21, wherein the solid flange has two grooves on its upper surface and two grooves on its lower surface.

* * * * *